United States Patent [19]

Wollenberg

[11] Patent Number: 4,755,312

[45] Date of Patent: Jul. 5, 1988

[54] CARBONATE TREATED DISPERSANTS

[75] Inventor: Robert H. Wollenberg, San Rafael, Calif.

[73] Assignee: Chevron Research Company, San Francisco, Calif.

[21] Appl. No.: 910,107

[22] Filed: Sep. 19, 1986

Related U.S. Application Data

[62] Division of Ser. No. 834,972, Feb. 28, 1986, Pat. No. 4,729,842, which is a division of Ser. No. 673,963, Nov. 21, 1984, Pat. No. 4,585,566.

[51] Int. Cl.[4] ..... C10M 133/16

[52] U.S. Cl. ..... 252/51.5 A; 252/51.5 R; 548/545; 549/228; 549/229

[58] Field of Search ..... 252/51.5 A, 51.5 R; 548/545; 549/228, 229

[56] References Cited

U.S. PATENT DOCUMENTS

| | | | |
|---|---|---|---|
| 2,802,022 | 8/1957 | Groszos et al. | 260/471 |
| 2,844,449 | 7/1958 | Dille et al. | 44/70 |
| 2,921,955 | 1/1960 | Newman et al. | 260/463 |
| 2,991,162 | 7/1961 | Malec | 44/58 |
| 3,216,936 | 11/1965 | Le Suêr | 252/32.7 |
| 3,367,943 | 2/1968 | Miller et al. | 260/326.3 |
| 3,373,111 | 3/1968 | Le Suer et al. | 252/51.5 |
| 3,652,240 | 3/1972 | Dorn et al. | 44/66 |
| 4,234,435 | 11/1980 | Meinhardt et al. | 252/51.5 A |
| 4,322,305 | 3/1982 | Lewis | 252/51.5 A |
| 4,410,437 | 10/1983 | Erdman | 252/47.5 |
| 4,460,381 | 7/1984 | Karol et al. | 44/63 |
| 4,482,464 | 11/1984 | Karol et al. | 252/51.5 A |
| 4,490,154 | 12/1984 | Sung et al. | 44/70 |
| 4,501,597 | 2/1985 | Karol et al. | 44/63 |
| 4,584,117 | 4/1986 | Wollenberg | 252/51.5 A |
| 4,585,566 | 4/1986 | Wollenberg | 252/51.5 A |
| 4,612,132 | 9/1986 | Wollenberg et al. | 252/51.5 A |

FOREIGN PATENT DOCUMENTS

| | | |
|---|---|---|
| 689705 | 4/1953 | United Kingdom . |

*Primary Examiner*—Jacqueline V. Howard
*Attorney, Agent, or Firm*—S. R. LaPaglia; R. C. Gaffney; G. F. Swiss

[57] ABSTRACT

Disclosed are additives which are useful as dispersants in marine crankcase oils and hydraulic oils, lubricating oils. In particular, disclosed are nitrogen-containing lubricating oil dispersants having at least one primary or secondary amino group which have been modified by treatment with a cyclic carbonate.

20 Claims, No Drawings

CARBONATE TREATED DISPERSANTS

This is a division of aplication Ser. No. 834,972, filed Feb. 28, 1986, now U.S. Pat. No. 4,729,842, which in turn is a division of application Ser. No. 673,963, filed Nov. 21, 1984, now U.S. Pat. No. 4,585,566.

FIELD OF THE INVENTION

Lubricating oil additives are prepared by reacting a dispersant composition containing at least one primary or secondary amino group with a cyclic carbonate.

DESCRIPTION OF THE PRIOR ART

Most commercial lubricating oils now contain dispersant additives to help keep the engine clean by dispersing sludge and varnish-forming deposits in the oil. Many of these dispersant additives contain basic nitrogen as primary or secondary amino groups.

Primary and secondary amino groups of a succinimide dispersant have been previously modified by treatment with an alkylene oxide (see U.S. Pat. Nos. 3,373,111 and 3,367,943). U.S. Pat. No. 2,991,162 and U.S. Pat. No. 3,652,240 disclose motor fuel additives which have been modified by treatment with ethylene carbonate.

Likewise, my previously filed pending application, U.S. Ser. No. 632,777, teaches the preparation of modified alkenyl or alkyl succinimide by treatment with a cyclic carbonate. These modified succinimides are disclosed as possessing enhanced dispersancy over the unmodified succinimides.

SUMMARY OF THE INVENTION

In addition to succinimides, it has now been found that the dispersant performance of other nitrogen-containing lubricating oil additives having at least one primary or secondary amino group is improved by reaction with a cyclic carbonate. Included among these additives are Mannich bases, borated Mannich bases, hydrocarbyl sulfonamides having at least one additional amino group, N-alkylaminophosphoramides, polyoxyalkylene polyamines and amino-decorated hydrogen polymers. Accordingly, the present invention is directed to an improved lubricating oil dispersant additive prepared by the process comprising contacting at a temperature sufficient to cause a reaction a nitrogen-containing lubricating oil dispersant having at least one primary or secondary amino group with a cyclic carbonate.

As noted above, the modified dispersants of this invention possess improved dispersancy properties. Thus, another aspect of this invention is a lubricating oil composition comprising a major amount of an oil of lubricating viscosity and a dispersant effective amount of a modified dispersant of this invention.

DETAILED DESCRIPTION OF THE INVENTION

The modified lubricating oil dispersants of this invention are prepared by reaction of a nitrogen-containing dispersant having at least one primary or secondary amino group with a cyclic carbonate. The reaction is conducted at a temperature sufficient to cause reaction of the cyclic carbonate with the primary or secondary amino group of the dispersant. In particular, reaction temperatures of from about 0° C. to about 250° C. are preferred with temperatures of from about 100° C. to 200° C. being most preferred.

The reaction may be conducted neat - that is, both the dispersant and the carbonate are combined in the proper ratio, either alone or in the presence of a catalyst, such as an acidic, basic or Lewis acid catalyst, and then stirred at the reaction temperature. Examples of suitable catalysts include, for instance, boron trifluoride, alkane sulfonic acid, alkali or alkaline carbonate.

Alternatively, the reaction may be conducted in a diluent. For example, the reactants may be combined in a solvent such as toluene, xylene, oil or the like, and then stirred at the reaction temperature. After reaction completion, volatile components may be stripped off. When a diluent is employed, it is preferably inert to the reactants and products formed and is generally used in an amount sufficient to insure efficient stirring.

Water, which can be present in the dispersant, may be removed from the reaction system either before or during the course of the reaction via azeotroping or distillation. After reaction completion, the system can be stripped at elevated temperatures (100° C. to 250° C. and reduced pressure to remove any volatile components which may be present in the product.

Mole ratios of the cyclic carbonate to the basic amine nitrogen of the dispersant employed in the process of this invention are generally in the range of from about 0.2:1 to about 10:1, although preferably from about 0.5:1 to about 5:1 and most preferably 1:1 to 3:1.

The reaction is generally complete from within 0.5 to 10 hours.

A. Carbonates

Cyclic carbonates employed in this invention react with a basic primary or secondary amine to form either a corresponding carbamate or a hydroxyalkylamine derivative. Suitable cyclic carbonates include:

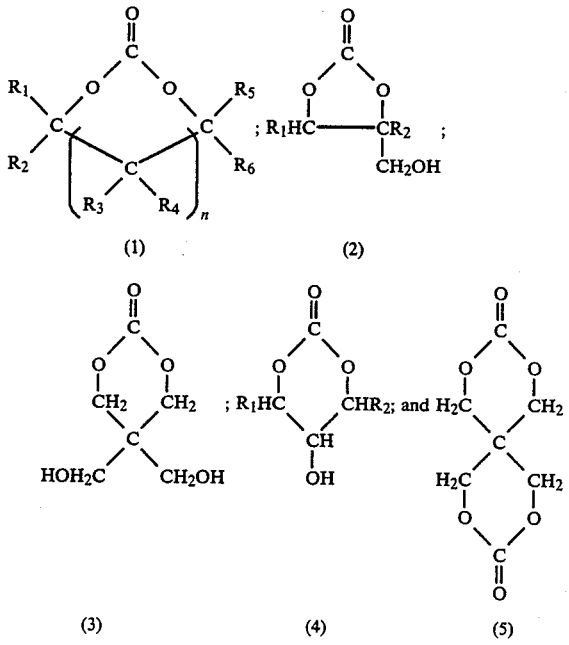

wherein $R_1$, $R_2$, $R_3$, $R_4$, $R_5$ and $R_6$ are independently selected from hydrogen or lower alkyl of 1 to 2 carbon atoms; and n is an integer from 0 to 1.

Preferred cyclic carbonates for use in this invention are those of formula 1 above. Preferred $R_1$, $R_2$, $R_3$, $R_4$, $R_5$ and $R_6$ are either hydrogen or methyl. Most preferably $R_1$, $R_2$, $R_3$, $R_4$, $R_5$ and $R_6$ are hydrogen, when n is one. $R_6$ is most preferably hydrogen or methyl while $R_1$, $R_2$, and $R_5$ are hydrogen when n is zero.

The following are examples of suitable cyclic carbonates for use in this invention: 1,3-dioxolan-2-one(ethylene carbonate); 4-methyl-1,3-dioxolan-2-one(propylene carbonate); 4-hydroxymethyl-1,3-dioxolan-2-one; 4,5-dimethyl-1,3-dioxolan-2-one; 4-ethyl-1,3-dioxolan-2-one; 4,4-dimethyl-1,3-dioxolan-2-one; 4-methyl-5-ethyl-1,3-dioxolan-2-one;4,5-diethyl-1,3-dioxolan-2-one; 4,4-diethyl-1,3-dioxolan-2-one;1,3-dioxan-2-one; 4,4-dimethyl-1,3-dioxan-2-one; 5,5-dimethyl-1,3-dioxan-2-one; 5,5-dihydroxymethyl-1,3-dioxan-2-one; 5-methyl-1,3-dioxan-2-one; 4-methyl-1,3-dioxan-2-one; 5-hydroxy-1,3-dioxan-2-one; 5,5-diethyl-1,3-dioxan-2-one; 5-methyl-5-propyl-1,3-dioxan-2-one; 4,6-dimethyl-1,3-dioxan-2-one; 4,4,6-trimethyl-1,3-dioxan-2-one and spiro[1,3-oxa-2-cyclohexanone-5,5'-1',3'-oxa-2'-cyclohexanone].

Several of these cyclic carbonates are commercially available such as 1,3-dioxolan-2-one or 4-methyl-1,3-dioxolan-2-one. Cyclic carbonates may be readily prepared by known reactions. For example, reaction of phosgene with a suitable alpha alkane diol or an alkan-1,3-diol yields a carbonate for use within the scope of this invention (see U.S. Pat. No. 4,115,206).

Likewise, the cyclic carbonates useful for this invention may be prepared by transesterification of a suitable alpha alkane diol or an alkan-1,3-diol with, e.g., diethyl carbonate under transesterification conditions. See, for instance, U.S. Pat. Nos. 4,384,115 and 4,423,205 which are incorporated herein by reference for their teaching of the preparation of cyclic carbonates.

As used herein, the term "alpha alkane diol" means an alkane group having two hydroxyl substituents wherein the hydroxyl substituents are on adjacent carbons to each other. Examples of alpha alkane diols include 1,2-propanediol, 2,3-butanediol and the like.

The term "alkan-1,3-diol" means an alkane group having two hydroxy substituents wherein the hydroxyl substituents are beta substituted. That is, there is a methylene or a substituted methylene moiety between the hydroxyl substituted carbons. Examples of alkan-1,3-diols include propan-1,3-diol, pentan-2,4-diol and the like.

As used herein, the term "spiro[1,3-oxa-2-cyclohexanone-5,5'-1',3'-oxa-2'cyclohexanone means the group

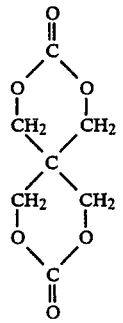

As used herein, the term "molar charge of cyclic carbonate to the basic nitrogen of the dispersant" means that the molar charge of cyclic carbonate employed in the reaction is based upon the theoretical number of basic nitrogens (i.e., nitrogens titratable by a strong acid) contained in the dispersant. Thus, when 1 equivalent of triethylene tetraamine (TETA) is reacted with an equivalent of hydrocarbyl carboxylic acid, the resulting amide will theoretically contain 3 basic nitrogens. Accordingly, a molar charge of 1 would require that a mole of cyclic carbonate be added for each basic nitrogen or in this case 3 moles of cyclic carbonate for each mole of amide prepared from TETA.

The alkpha alkane diols, used to prepare the 1,3-dioxolan-2-ones employed in this invention, are either commercially available or may be prepared from the corresponding olefin by methods known in the art. For example, the olefin may first react with a peracid, such as peroxyacetic acid or hydrogen perioxide plus formic acid to form the corresponding epoxide which is readily hydrolyzed under acid or base catalysis to the alpha alkane diol. In another process, the olefin is first halogenated to a dihalo derivative and subsequently hydrolyzed to an alkpha alkane diol by reaction first with sodium acetate and then with sodium hydroxide. The olefins so employed are known in the art.

The alkan-1,3-diols, used to prepare the 1,3-dioxan-2-ones employed in this invention, are either commercially available or may be prepared by standard techniques, e.g., derivatizing malonic acid.

4-Hydroxymethyl 1,3-dioxolan-2-one derivatives and 5-hydroxy-1,3-dioxan-2-one derivatives may be prepared by employing glycerol or substituted glycerol in the process of U.S. Pat. No. 4,115,206. The mixture so prepared may be separated, if desired, by conventional techniques. Preferably the mixture is used as is.

5,5-Dihydroxymethyl-1,3-dioxan-2-one may be prepared by reacting an equivalent of pentaerythritol with an equivalent of either phosgene or diethylcarbonate (or the like) under transesterification conditions.

Spiro[1,3-oxa-2-cyclohexanone-5,5'-1',3'-oxa-2'-cyclohexanone may be prepared by reacting an equivalent of pentaerythritol with two equivalents of either phosgene or diethylcarbonate (or the like) under transesterification conditions.

B. Nitrogen-Containing Dispersants

The dispersants whose performance is improved by the process of this invention must contain at least one basic nitrogen and have at least one >NH group. The essence of this invention resides in the surprising discovery that treating the lubricating oil dispersant with a cyclic carbonate improves its dispersant properties. The dispersants include Mannich bases, borated Mannich bases, hydrocarbyl sulfonamides having at least one additional amino group, N-alkylaminophosphoramides, polyoxyalkylene polyamines, and amino-decorated hydrocarbon polymers useful as dispersant-viscosity index improvers.

The Mannich bases used for preparing the additives of this invention are also well known. Representative types of Mannich bases are described in U.S. Pat. Nos. 3,741,896, 3,539,633 and 3,649,229, the disclosures of which are hereby incorporated by reference. In general, the Mannich bases are prepared by reacting an alkylphenol, formaldehyde, and a mono- or polyamine. The Mannich base may be borated by reacting with, e.g., a boron halide, boric acid, or an ester of boric acid. Preferred amines for use in forming the Mannich base are methylamine and ethyleneamines such as ethylenediamine, diethylenetriamine, and triethylenetetraamine.

The hydrocarbyl sulfonamides for use in preparing the additives of this invention are described in U.S. Pat. No. 4,122,266, the disclosure of which is hereby incorporated by reference. The sulfonamides are preferably prepared from a hydrocarbyl sulfonyl chloride and an amine. Particularly preferred are the reaction products of polyisobutenylsulfonyl chloride containing 50 to 300 carbon atoms and an ethylene amine such as diethylenetriamine, triethylenetetraamine, and tetraethylenepentamine.

Amino-decorated hydrocarbon polymers useful as dispersant viscosity index improvers are usually prepared by treating a hydrocarbon polymer having viscosity index improving characteristics, such as an ethylene-propylene copolymer or terpolymer, either chemically or mechanically to generate active sites and then reacting with an amine or polyamine. Typical products are prepared by oxidizing the copolymer or terpolymer and reacting with an amine as shown in U.S. Pat. No. 3,769,216 or with an amine an aldehyde as shown in U.S. Pat. No. 3,872,019, the disclosure of which are hereby incorporated by reference.

Similarly, other primary or secondary amine-substituted polymers used as viscosity-index improvers may be used as starting materials for the additives of the invention. Such polymers include amine-grafted acrylic polymers and copolymers and copolymers wherein one monomer contains at least one amino group. Typical compositions are described in British Pat. No. 1,488,382, U.S. Pat. Nos. 4,089,794 and 4,025,452, the disclosures of which are incorporated herein by reference.

The polyoxyalkylene polyamine additives consists of three parts or moieties. The first is the polyether or polyoxyalkylene moiety, which may or may not be hydrocarbyl terminated or "capped". The polyether moiety is bound through the second moiety, a connecting group or linkage to the nitrogen atom of the third moiety, the amine.

Polyoxyalkylene Moeity

The polyoxyalkylene moiety is ordinarily comprised of polyoxyalkylene polymers containing at least one oxyalkylene unit, preferably 1 to 30 units, and more preferably 5 to 30 units, and most preferably 10 to about 25 oxyalkylene units. When polymerized in the polymerization reaction, a single type of alkylene oxide may be employed. Copolymers, however, are equally satisfactory and random copolymers are readily prepared. Blocked copolymers of oxyalkylene units also provide satisfactory polyoxyalkylene polymers for the practice of the present invention.

The polyoxyalkylene moiety may also be terminated or "capped" by a hydrocarbyl terminating group. This terminating group may be comprised of an alkyl group of from 5 to about 30 carbon atoms, an aryl group of from 6 to about 30 carbon atoms, an alkaryl group of from 7 to about 30 carbon atoms, an aralkyl group of from 7 to about 30 carbon atoms, or a methylol-substituted alkyl group of from 5 to about 10 carbon atoms.

The polyoxyalkylene moiety may ordinarily be prepared in a variety of ways, the most common for the practice of the present invention being by the reaction of an appropriate lower alkylene oxide containing from 2 to 4 carbon atoms with an appropriate initiator; for example, chlorohydrin or an alkyl phenol. In a preferred embodiment, ethylene chlorohydrin is used. Copolymers may be readily prepared by contacting the initiator compound with a mixture of alkylene oxides, while the blocked copolymers may be prepared by reacting the initiator first with one alkylene oxide and then another in any order or repetitively under polymerization conditions.

As an example, the polyoxyalkylene moiety derived from an alkyl phenol initiated polymerization detailed above is prepared as an alcohol containing a terminal hydroxyl group. The polyether moiety is then attached through the appropriate connecting group to the polyamine moiety by a variety of ways, one of which includes reacting the hydroxyl group of the polyoxyalkylene unit with phosgene to form a polyoxyalkylene chloroformate and then reacting the polyoxyalkylene chloroformate with an amine. Alternatively, the hydroxyl group may be reacted with epichlorohydrin to give a methylol-substituted ethyl chloride end group. The resulting polyoxyalkylene alkyl chloride is then reacted with an amine or polyamine to produce the composition to be quaternized, resulting in the composition of the present invention.

The Connecting Group

The connecting group joining the polyoxyalkylene moiety with the amine moiety may be any relatively small diradical containing at least one carbon, oxygen, sulfur and/or nitrogen atom, and usually containing up to 12 carbon atoms. The connecting group which results and is used in the present composition is ordinarily a function of the method by which the compositions are formed and/or by which the components of the polyoxyalkylene moiety and the polyamine moiety are joined together. Appropriate connecting groups include:

carbamates $-O-\overset{\overset{\displaystyle O}{\|}}{C}-NH-$;

ethylene $-\overset{\overset{\displaystyle Z}{|}}{CH}-\overset{\overset{\displaystyle Z'}{|}}{CH}-$;

oxyethylene $\leftarrow CH_2-CH_2O \rightarrow$ methylol ethylene $-\overset{\overset{\displaystyle CH_2OH}{|}}{CH}-CH_2-$;

succinates $-O-\overset{\overset{\displaystyle O}{\|}}{C}-CH_2-CH_2-\overset{\overset{\displaystyle O}{\|}}{C}-O-$;

ethers $-O-$;
thioethers $-S-$;

carbonyls $-\overset{\overset{\displaystyle O}{\|}}{C}-$;

esters $-\overset{\overset{\displaystyle O}{\|}}{C}-O$;

amides $-\overset{\overset{\displaystyle O}{\|}}{C}-NZ-$; and methylene $-CHZ-$;

where Z and Z' independently = H, or an alkyl group of from 1 to 2 carbon atoms.

The Amine Moiety

The amine moiety of the polyoxyalkylene polyamine is derived from ammonia or, more preferably, from a polyamine having from about 2 to about 12 amine nitrogen atoms and from about 2 to about 40 carbon atoms. The polyamine preferably has a carbon to nitrogen ratio of from about 1:1 to about 10:1. The polyamine may be substituted with a substituent group selected from (A) hydrogen; (B) hydrocarbyl groups from about 1 to about 10 carbon atoms; (C) acyl groups from about 2 to about 10 carbon atoms; and (D) monoketo, monocyano, lower alkyl and lower alkoxy derivatives of (B), (C). "Lower", as used in lower alkyl and lower alkoxy, means a group containing about 1 to 6 carbon atoms. "Hydrocarbyl" denotes an organic radical composed of carbon and hydrogen which may be aliphatic, alicyclic, aromatic or combinations thereof, e.g., aralkyl. The substituted polyamines of the present invention are generally, but not necessarily, N-substituted polyamines. The acyl groups falling within the definition of the aforementioned (C) substituents are such as propionyl, acetyl, etc. The more preferred substituents are hydrogen, $C_1$ to $C_6$ alkyls, and $C_1$–$C_6$ hydroxyalkyls.

The more preferred polyamines finding use within the scope of the present invention are polyalkylene polyamines, including alkylene diamine and substituted polyamines, e.g., alkyl and hydroxyalkyl-substituted polyalkylene polyamines. Preferably the alkylene groups contain from 2 to 6 carbon atoms, there being preferably from 2 to 3 carbon atoms between the nitrogen atoms. Such groups are exemplified by ethyleneamines and include ethylene diamine, diethylene triamine, di(trimethylene) triamine, dipropylenetriamine, triethylenetetramine, etc. Such amines encompass isomers which are the branched-chain polyamines and the previously mentioned substituted polyamines, including hydroxy and hydrocarbyl-substituted polyamines. Among the polyalkylene polyamines, those containing 2 to 12 amine nitrogen atoms and 2 to 24 carbon atoms, are especially preferred and the $C_2$ to $C_3$ alkylene polyamines are most preferred, in particular, the lower polyalkylene polyamines, e.g., ethylene diamine, tetraethylenepentamine, etc.

In many instances a single compound will not be used as reactant in the preparation of the compositions of this invention, in particular the polyamine component. That is, mixtures will be used in which one or two compounds will predominate with the average composition indicated.

A generalized, preferred formula for the polyoxyalkylene polyamines finding utility in this invention is as follows:

$$R-O-(CH(R^{i})-CH(R^{ii})-O)_{n-1}-CH(R^{i})-CH(R^{ii})-X-R^{iii}$$

wherein

R = an alkyl group of 5 to 30 carbon atoms, aryl group of 6 to 30 carbon atoms, alkaryl group of 7 to 30 carbon atoms, aralkyl group of 7 to 30 carbon atoms, or methylol-substituted alkyl group of 5 to 30 carbon atoms;

$R^{i}$ and $R^{ii}$ independently = hydrogen, methyl or ethyl;

n = 1 to 30, preferably 10 to 25;

X = the connecting group as defined above;

$$R^{iii} = -(CH_2CH_2N(H))_x-H,$$

where X = 1 to 5.

C. Modified Dispersant Complexes

Cyclic carbonates of Formula I are used to illustrate the reaction of the carbonate with a nitrogencontaining dispersant. It is to be understood that the other cyclic carbonates employed in this invention react similarly. Cyclic carbonates react with the primary and secondary amines of a dispersant to form two types of compounds. In the first instance, strong bases, including unhindered amines such as primary amines and some secondary amines, react with an equivalent of cyclic carbonate to produce a carbamic ester as shown in reaction (1) below:

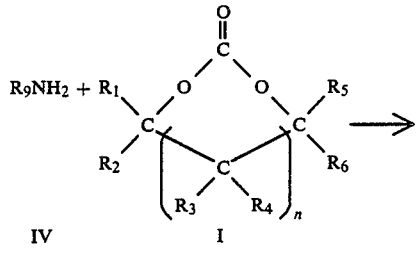

wherein $R_1$, $R_2$, $R_3$, $R_4$, $R_5$, $R_6$ and n are as defined above and $R_9$ is the remainder of a dispersant. In this reaction, the amine nitrogen has been rendered nonbasic by formation of the carbamate, V.

In the second instance, hindered bases, such as hindered secondary amines, may react with an equivalent of the same cyclic carbonate to form a hydroxyalkyleneamine linkage with the concomitant elimination of $CO_2$ as shown below in reaction (2):

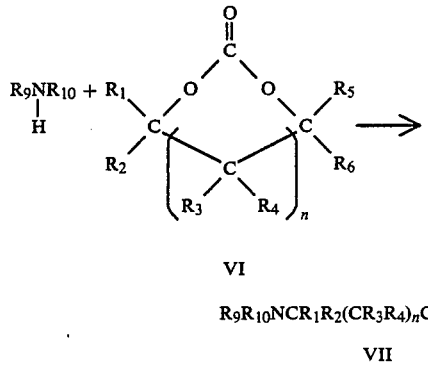

wherein $R_1$, $R_2$, $R_3$, $R_4$, $R_5$, $R_6$, $R_9$ and n are as defined above and $R_{10}$ is an alkyl or alkylene linking group which hinders the amine. Unlike the carbamate products of reaction (1), the hydroxyalkyleneamine products of reaction (2) retain their basicity. These hydroxyalkyleneamine derivatives, VII, (when n = 0) are believed to be similar to those which are produced by the addition of a substituted ethylene oxide of the formula:

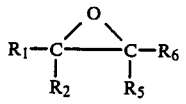

VIII wherein $R_1$, $R_2$, $R_5$ and $R_6$ are as defined above. (See for instance U.S. Pat. Nos. 3,367,943 and 3,377,111).

In theory, if only primary and secondary amines are employed a determination of whether the carbonate addition follows reaction (1) or reaction (2) could be made by monitoring the AV (alkalinity value or alkalinity number - refers to the amount of base as milligrams of KOH in 1 gram of a sample) of the product. Accordingly, if the reaction proceeded entirely via reaction (1) above, a reaction product prepared by reacting an equivalent of carbonate for each basic nitrogen should yield an AV of zero. That is to say that all the basic amines in the polyamine moiety have been converted to nonbasic carbamates.

However, alkylene polyamines such as triethylene tetraamine and tetraethylene pentamine, contain tertiary amines (piperazines, etc.) which may account for as much as 30% of the basic nitrogen content. Although Applicant does not want to be limited to any theory, it is believed that these tertiary amines, although basic, are not reactive with the carbonate. Accordingly, even if the reaction proceeded entirely by reaction (1) above, an AV of approximately 30% of the original AV may be retained in the final product of such a polyamine. Nevertheless, a large drop in the AV of the product is significant evidence that a substantial portion of the reaction product contains carbamic esters.

In fact, the addition of the first molar charge of ethylene carbonate results in an appreciable lowering of the AV of the product.

The addition of a second molar charge of ethylene carbonate in these reactions does not result in appreciably further lowering of the AV. This suggests that the additional carbonate either reacts via reaction (2) above to form hydroxyalkyleneamine groups or are reacting with the hydroxyl group of the carbamate as shown in reaction 3(a) below:

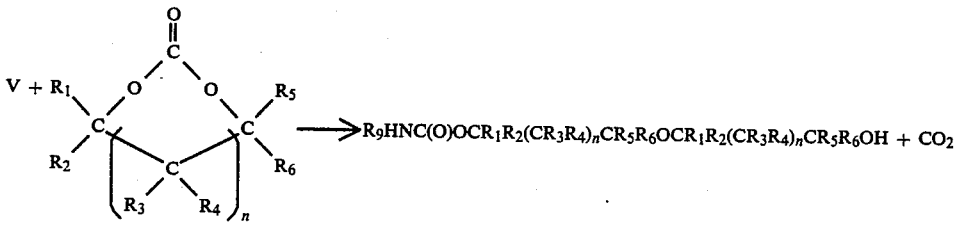

(3a)

I IX wherein $R_1$, $R_2$, $R_3$, $R_4$, $R_5$, $R_6$, $R_9$ and n are as defined above.

The process of reaction 3(a) allows for additional carbonate to add to the hydroxyl group of product IX as shown in reaction 3(b) below:

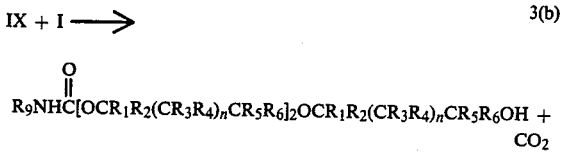

3(b)

wherein $R_1$, $R_2$, $R_3$, $R_4$, $R_5$, $R_6$ and $R_{10}$ are as defined above. As is apparent from the above reaction, the poly(oxyalkylene) portion of the carbamate can be repeated several times simply by addition of more carbonate.

Likewise, additional equivalents of carbonate could equally add to the hydroxyl group of the hydroxyalkyleneamine derivative, VII, of reaction (2) as shown in reaction (4) below:

$$VII + I \rightarrow R_9R_{10}N[CR_1R_2(CR_3R_4)_nCR_5R_6O]_2H \quad (4)$$

XI wherein $R_1$, $R_2$, $R_3$, $R_4$, $R_8$, $R_9$ and $R_{10}$ are as defined above. Repeating the process of reaction (4) above by the addition of increasing amounts of carbonate produces a hydroxyalkylenepoly(oxyalkylene)amine derivative of Formula XII below:

$$R_9R_{10}N[CR_1R_2(CR_3R_4O)_nCR_5R_6]_yH$$

XII wherein $R_1$, $R_2$, $R_3$, $R_4$, $R_8$, $R_9$, $R_{10}$ and n are as defined above and y is an integer from 3 to 10.

It is also contemplated that reactions (3) and (4) above may also produce acyclic carbonate linkages with the terminal hydroxl group. Likewise, if $R_9$ (or $R_{10}$) is hydrogen, then an additional hydroxyalkylene could add to the amino group.

Accordingly, it is expected that the reaction of a cyclic carbonate with a nitrogen-containing dispersant will yield a mixture of products. When the molar charge of the cyclic carbonate to the basic nitrogen of the dispersant is about 1 or less, it is anticipated that a large portion of the primary and secondary amines of the dispesant will have been converted to carbamic esters with some hydroxyalkyleneamine derivatives also being formed. As the molar charge is raised above 1, poly(oxyalkylene) polymers of the carbamic esters and the hydroxyalkyleneamine derivatives are expected.

It is expected that use of the spiro[1,3-oxa-2-cyclohexanone-5,5'-1',3'-oxa-2'-cyclohexanone] will yield materials which would be both internally cyclized and cross-linking between two dispersant molecules.

In some instances, it may be desirable to increase the proportion of carbamic esters formed in these reactions. This may be accomplished by employing a polyamine with a large percentage of primary amine. Another method may be to employ alkyl-substituted (i.e., one or more of $R_1$, $R_2$, $R_3$, $R_4$, $R_5$, or $R_6$ is alkyl) or hydroxyalkyl substituted carbonates.

The modified dispersant of this invention can be reacted with boric acid or a similar boron compound to form borated dispersants having utility within the scope of this invention. In addition to boric acid (boron acid), examples of suitable boron compounds include boron oxides, boron halides and esters of boric acid. Generally from about 0.1 equivalents to 10 equivalents of boron compound to the modified dispersant may be employed.

The modified dispersants of this invention are useful as detergent and dispersant additives when employed in lubricating oils. When employed in this manner, the modified dispersant additive is usually present in from 0.2 to 10 percent by weight to the total composition and preferably at about 0.5 to 5 percent by weight. The lubricating oil used with the additive compositions of this invention may be mineral oil or synthetic oils of lubricating viscosity and preferably suitable for use in the crankcase of an internal combustion engine. Crankcase lubricating oils ordinarily have a viscosity of about 1300 CSt 0° F. to 22.7 CSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Additive concentrates are also included within the scope of this invention. The concentrates of this invention usually include from about 90 to 10 weight percent of an oil of lubricating viscosity and from about 10 to 90 weight percent of the complex additive of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

Other additives which may be present in the formulation include rust inhibitors, foam inhibitors, corrosion inhibitors, metal deactivators, pour point depressants, antioxidants, and a variety of other well-known additives.

It is also contemplated the modified dispersants of this invention may be employed as dispersants and detergents in hydraulic fluids, marine crankcase lubricants and the like. When so employed, the modified dispersant is added at from about 0.1 to 10 percent by weight to the oil. Preferably, at from 0.5 to 5 weight percent.

The following examples are offered to specifically illustrate this invention. These examples and illustrations are not to be construed in any way as limiting the scope of this invention.

EXAMPLES

EXAMPLE 1

To a 500 ml reaction flask was charged 100 g of a hydrocarbyl amine dispersant, prepared from polyisobutenyl chloride (where the polyisobutenyl group has a number average weight of 1325) and ethylene diamine, containing about 50% diluent oil, and having an alkalinity value (AV)=41.6 mg KOH/g. 3.27 g Ethylene carbonate were added and the reaction mixture heated to 150° C. under $N_2$ and stirred for 4 hours. The mixture was then cooled, diluted with 200 ml 350° F. thinners, and stripped to 175° C. and 5 mm Hg. Recovered 102.1 g product having an AV=19.7 and containing 0.99% N.

EXAMPLE 2

To a 500 ml reaction flask was charged 100 g of the hydrocarbyl amine dispersant described in Example 1 and 13.08 g ethylene carbonate. The reaction mixture was heated to 150° C. under $N_2$ and stirred for 4 hours. The mixture was then cooled, diluted with 200 ml 350° F. thinners, and stripped to 175° C. and 5 mm Hg. Recovered 112.9 g product having an AV=12.8 and containing 0.88% N.

EXAMPLE 3

To a 500 ml reaction flask was charged 100 g of the hydrocarbyl amine dispersant of Example 1 and 7.44 g propylene carbonate. The reaction mixture was heated to 150° C. under $N_2$ and stirred for 4 hours. The mixture was then cooled, diluted with 200 ml 350° F. thinners, and stripped to 157° C. and 10 mm Hg. Recovered 106.6 g product having an AV=17.2 and containing 0.94% N.

EXAMPLE 4

To a 500 ml reaction flask was charged 100 g of an amide detergent composition prepared from an aliphatic carboxylic acid of approximately 280 molecular weight and tetraethylenepentamine (where the ratio of carboxylic acid to polyamine is about 3 to 1 and having an AV=102). The amide was heated to 170° C. under $N_2$ and 16.5 g ethylene carbonate was added. The reaction mixture was then stirred at 170° C. for 4 hours. Recovered 112 g product having an AV=70.9 and containing 5.89% N.

EXAMPLE 5

To a 500 ml reaction flask was charged 100 g of a poly(oxyalkylene) amino carbamate prepared by reacting a hydrocarbyl-capped poly(butylene oxide) chloroformate of approximately 1400 molecular weight with ethylene diamine and having an AV=10.9. The amine was heated to 170° C. under $N_2$ and 1.7 g ethylene carbonate added. The reaction mixture was then stirred at 170° C. for 4 hours. Recovered 101.3 g product having an AV=2.5 and containing 0.66% N.

EXAMPLE 6

To a 500 ml reaction flask was charged 100 g of an amine-functionalized ethylene-propylene rubber of 30,000–200,000 MW in 89 g of lubricating diluent oil. The polymer was heated to 170° C. under $N_2$ and 0.1 g ethylene carbonate added. The reaction mixture was stirred at 170° C. for 4 hours. Recovered 99.2 g product containing 131 ppm N.

EXAMPLE 7

To a 500 ml reaction flask was charged 100 g of Amoco 9050 (1.2% N; a Mannich dispersant prepared by reacting a polyisobutenyl-substituted phenol with formaldehyde and a polyamine and having an AV=28.9). The Mannich dispersant was heated to 170° C. under $N_2$ and 14.0 g ethylene carbonate added. The reaction mixture was stirred at 170° C. for 4 hours. Recovered 106.4 g product having an AV=20.7 and containing 1.07% N.

What is claimed is:

1. A product prepared by the process which comprises reacting at a temperature sufficient to cause reaction an amino-decorated hydrocarbon polymer having at least one primary or secondary amine group wtih a cyclic carbonate and wherein the molar charge of cyclic carbonate to the basic nitrogen of the amino-decorated hydrocarbon polymer is from about 0.2:1 to about 10:1.

2. A product prepared as in the process of claim 1 wherein the cyclic carbonate is selected from the group consisting of

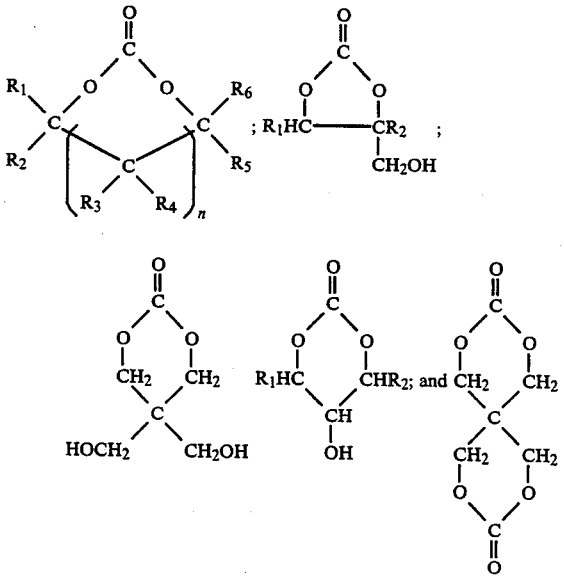

wherein $R_1$, $R_2$, $R_3$, $R_4$, $R_5$ and $R_6$ are independently selected from hydrogen or alkyl of 1 to 2 carbon atoms; and n is an integer from 0 to 1.

3. A product prepared as in the process of claim 2 wherein the cyclic carbonate is

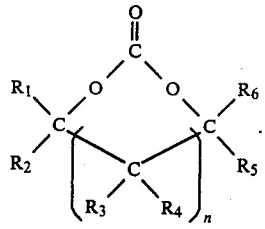

4. A product prepared as in the process of claim 3 wherein n is zero; $R_1$, $R_2$ and $R_5$ are hydrogen; and $R_6$ is hydrogen or methyl.

5. A product prepared as in the process of claim 4 wherein $R_6$ is hydrogen.

6. A product prepared as in the process of claim 1 wherein the reaction is conducted at from 0° to 250° C.

7. A product prepared as in the process of claim 1 wherein the molar charge of the cyclic carbonate to the basic nitrogens of the amino-decorated hydrocarbon polymer viscosity index is from about 0.5:1 to about 5:1.

8. A product prepared as in the process of claim 7 wherein the molar charge of the cyclic carbonate to the basic nitrogens of the amino-decorated hydrocarbon polymer is from about 1:1 to about 3:1.

9. A lubricating oil composition comprising an oil of lubricating viscosity and from 0.2 to 10 percent by weight of a product is defined in claim 1.

10. A lubricating oil composition comprising an oil of lubricating viscosity and from 0.2 to 10 percent by weight of a product as defined in claim 2.

11. A lubricating oil composition comprising an oil of lubricating viscosity and from 0.2 to 10 percent by weight of a product as defined in claim 3.

12. A lubricating oil composition comprising an oil of lubricating viscosity and from 0.2 to 10 percent by weight of a product as defined in claim 4.

13. A lubricating oil composition comprising an oil of lubricating viscosity and from 0.2 to 10 percent by weight of a product as defined in claim 5.

14. A lubricating oil concentrate comprising from about 90 to 10 weight percent of an oil of lubricating viscosity and from about 10 to 90 weight percent of a product as defined in claim 1.

15. A lubricating oil concentrate comprising from about 90 to 10 weight percent of an oil of lubricating viscosity and from about 10 to 90 weight percent of a product as defined in claim 2.

16. A lubricating oil concentrate comprising from about 90 to 10 weight percent of an oil of lubricating viscosity and from about 10 to 90 weight percent of a product as defined in claim 3.

17. A lubricating oil concentrate comprising from about 90 to 10 weight percent of an oil of lubricating viscosity and from about 10 to 90 weight percent of a product as defined in claim 4.

18. A lubricating oil concentrate comprising from about 90 to 10 weight percent of an oil of lubricating viscosity and from about 10 to 90 weight percent of a product as defined in claim 5.

19. A process for the preparation of modified amino-decorated hydrocarbon polymers which comprises contacting at a temperature sufficient to cause reaction an amino-decorated hydrocarbon polymer having at least one primary or secondary amine group with a cyclic carbonate and wherein the molar charge of cyclic carbonate to the basic nitrogens of the amino-decorated hydrocarbon polymer is from about 0.2:1 to about 10:1.
20. The process of claim 19 wherein the cyclic carbonate is selected from the group consisting of
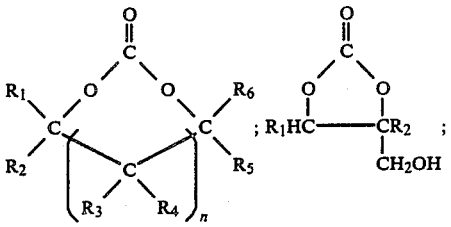
-continued
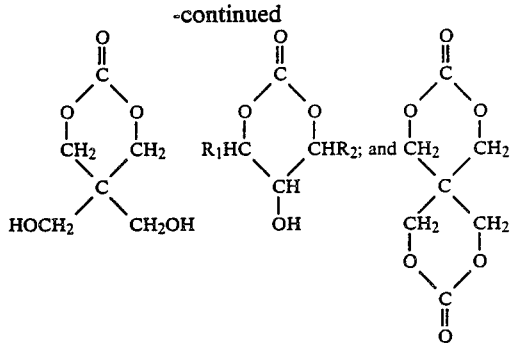
wherein $R_1$, $R_2$, $R_3$, $R_4$, $R_5$ and $R_6$ are independently selected from hydrogen or alkyl of 1 to 2 carbon atoms; and n is an integer from 0 to 1.
* * * * *